United States Patent [19]

Weisshuhn et al.

[11] Patent Number: 4,906,336

[45] Date of Patent: Mar. 6, 1990

[54] HEADBOX DEVICE FOR A PAPERMAKING MACHINE

[75] Inventors: Elmer Weisshuhn, Vogt; Herbert Holik, Ravensburg, both of Fed. Rep. of Germany

[73] Assignee: Sulzer-Escher Wyss GmbH, Ravensburg, Fed. Rep. of Germany

[21] Appl. No.: 204,302

[22] Filed: Jun. 9, 1988

Related U.S. Application Data

[63] Continuation-in-part of Ser. No. 880,544, Jun. 30, 1986, abandoned.

[30] Foreign Application Priority Data

Jul. 12, 1985 [CH] Switzerland ..... 3045/85

[51] Int. Cl.[4] ..... B21F 1/02

[52] U.S. Cl. ..... 162/336; 162/343; 162/344; 162/347

[58] Field of Search ..... 162/344–347, 162/336, 343

[56] References Cited

U.S. PATENT DOCUMENTS

| | | | |
|---|---|---|---|
| 1,809,937 | 6/1931 | Hisheimer | 162/347 |
| 3,725,197 | 4/1973 | Dahl et al. | 162/343 |
| 3,738,910 | 6/1973 | Noyer | 162/347 |
| 3,769,154 | 10/1973 | Wolf | 162/336 |
| 3,853,695 | 12/1974 | Back et al. | 162/347 |
| 3,954,558 | 4/1976 | Egelhof | 162/336 |
| 4,243,483 | 1/1981 | Schiel et al. | 162/347 |
| 4,414,062 | 11/1983 | Kirjavainen | 162/336 |
| 4,551,204 | 5/1985 | Holik et al. | 162/336 |

FOREIGN PATENT DOCUMENTS

| | | | |
|---|---|---|---|
| 2852564 | 6/1979 | Fed. Rep. of Germany . | |
| 1396309 | 3/1965 | France . | |
| 1494138 | 7/1967 | France . | |
| 964044 | 10/1982 | U.S.S.R. | 162/343 |
| 733441 | 7/1955 | United Kingdom . | |

*Primary Examiner*—Karen M. Hastings

*Attorney, Agent, or Firm*—Werner W. Kleeman

[57] ABSTRACT

A fiber stock suspension is directed from a guide device through the nozzle chamber of the headbox device and out of the slice opening thereof onto a papermaking machine. This nozzle chamber comprises at least two zones or sections. The first zone subsequent to the guide device possesses a relatively low convergence angle or low angle of wall inclination of the headbox device relative to the direction of flow of the fiber stock suspension. The other or second zone is positioned prior to or immediately upstream of the slice opening and possesses a substantially greater convergence angle or angle of wall inclination. In the first zone subsequent to the guide device, an improved flow stabilization or quieting of the flow of the fiber stock suspension occurs after the deflection of the fiber stock suspension and the creation of turbulence by the guide device. In the second zone prior to the slice opening the fiber stock suspension is strongly accelerated. This results in an improved quality of the formation of the paper web and the longitudinal and transverse strength of such paper web which is formed in the papermaking machine.

9 Claims, 1 Drawing Sheet

HEADBOX DEVICE FOR A PAPERMAKING MACHINE

CROSS-REFERENCE TO RELATED APPLICATION

This application is a continuation-in-part application of the commonly assigned, co-pending U.S. Pat. Application Ser. No. 06/880,544, filed on Jun. 30, 1986, entitled "HEADBOX DEVICE FOR A PAPERMAKING MACHINE", now abandoned.

BACKGROUND OF THE INVENTION

The present invention broadly relates to a new and improved construction of a headbox device for a papermaking machine.

Generally speaking, the present invention relates to a new and improved headbox device for a papermaking machine and comprises a distribution box or distributor and a guide device operatively connected thereto for deflecting and guiding a fiber stock suspension in the direction of the papermaking machine and for distributing the fiber stock suspension across the width of such papermaking machine. The guide device is in flow communication with a nozzle chamber. This nozzle chamber comprises two boundary walls or lip members and a slice opening leading or opening into the papermaking machine and therefore towards the paper web formed thereby. At least one of the lip members or boundary walls or lips of the nozzle chamber comprises at least two sections or zones having different angles of inclination or convergence angles relative to the direction of flow of the fiber stock suspension in the nozzle chamber.

Headbox devices of the aforementioned type are known, for example, from the German Pat. Publication No. 3,321,406, published Dec. 13, 1984, and the U.S. Pat. No. 3,738,910, granted Jun. 12, 1973. According to these patents the guide device is formed, for example, as a perforated plate or as a step-diffusor. This produces a certain turbulence in the fiber stock suspension entering the nozzle chamber from the distribution box in the forward or operating direction of the papermaking machine. The lip members bounding the nozzle chamber are, as a rule, formed as flat or slightly bent or curved walls. Often an adjustable slice shutter or baffle is provided at an end of the nozzle chamber at the slice opening. This slice shutter or baffle is used for effecting transverse profile corrections as well as for increasing stock turbulence. The slice shutter or baffle is inclined with respect to the vertical in the direction of flow usually by an angle of less than 35° and only projects a short distance into the nozzle chamber. This projection of the slice shutter or baffle is, for example, less than 5 mm so that the ratio of the shutter advance to the slice opening width is normally less than 0.5.

These known headboxes exhibit the following disadvantages: frequently insufficient formation quality of the formed paper web; too great a degree of sensitivity of the weight distribution within the paper web in cross-section, with dimensional anomalies or local changes in the width of the slice opening; too great a sensitivity with respect to differences in jet speeds of the fiber stock suspension during transverse profile corrections; as well as in some cases failure to achieve the desired high values of longitudinal/transverse strength of the formed paper web.

SUMMARY OF THE INVENTION

Therefore, with the forgoing in mind, it is a primary object of the present invention to provide a new and improved construction of a headbox device for a papermaking machine which does not exhibit the aforementioned drawbacks and shortcomings of the prior art constructions.

Another and more specific object of the present invention aims at providing a new and improved construction of a headbox device of the previously mentioned type having a distribution box or distributor and a guide device connected thereto for deflecting and guiding a fiber stock suspension or fiber stock in the direction of the papermaking machine and for distributing the fiber stock suspension across the width of the papermaking machine.

A further important object of the present invention aims at providing a new and improved headbox device for a papermaking machine which has sufficient formation quality of the paper web, lower sensitivity of the weight distribution of the paper web or sheet in transverse direction in the presence of dimensional anomalies or deviations of the width of the slice opening, reduced sensitivity with respect to differences in stock jet speeds in the presence of transverse profile corrections, as well as a higher ratio of longitudinal to transverse strength of the formed paper web.

Yet a further significant object of the present invention aims at providing a new and improved construction of a headbox device for a papermaking machine which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the headbox device for a papermaking machine of the present invention is manifested by the features that the angle of inclination or the convergence angle of at least one boundary wall or lip member of the first section or zone of the nozzle chamber which is connected directly subsequent to the guide device lies between 0° and 30° and the angle of inclination or the convergence angle of the second section or zone of the nozzle chamber lying directly before or upstream of the slice opening lies between 60° and 90°.

It is especially advantageous for the length of the first section or zone of the nozzle chamber, defining a quieting zone, located subsequent to the guide device, which is, for instance, constituted by a step diffusor, to be substantially greater, for instance about four times greater, than the length of the second section or zone, defining an acceleration zone, positioned prior to or upstream of the slice opening.

In this manner, a sufficient stabilization or quieting or so-to-speak smoothing of the fiber stock suspension is achieved in the first or initial quieting zone or section having the smaller angle of inclination after the occurrence of stock deflection and generation of turbulence for the purpose of dispersion of the fiber floccules. The effect of this quieting zone is to equalize the irregularities in the flow velocity of the fiber stock suspension. Such flow velocity irregularities typically emanate from the walls of the step diffusor of the guide device and which walls cannot be infinitely thin. At this quieting zone, the position and orientation of the fibers are stochastically distributed. In the second or subsequent acceleration zone or section located shortly before or upstream of the slice opening, the fiber stock suspension is then abruptly and strongly or markedly accelerated as a result of the greater inclination of the boundary wall or lip member of the nozzle chamber. At the acceleration zone, there arise greater shear forces. Fiber floccules which are present or newly formed fiber floccules are, in this manner, contorted or disintegrated. A "soft" or smooth formation of the fiber stock suspension is thus produced. Additionally, orientation of the fibers in the lengthwise or longitudinal direction is possible. Furthermore, there is ensured for a better formation and the longitudinal to transverse strength ratio of the paper web is increased. This is due to the fact that the fibers are already pre-oriented in the longitudinal direction at the slice opening by the strong acceleration of the fibers effluxing from the headbox. Since this prevailing energy state is only stable for a short period of time, it is important that the acceleration zone is located immediately adjacent or near the slice opening. Furthermore, disturbances or interruptions of the system are reduced or eliminated by the relatively long stabilization or quieting path of the nozzle chamber for the fiber stock suspension and the increased time duration between the generation of turbulence in the fiber stock suspension and its arrival at the slice opening. The acceleration of the fiber stock suspension is not selected so large, however, that turbulent vortexes or eddies are created.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various drawings there have been generally used the same reference characters to denote the same or analogous components and wherein.

DETAILED DESCRIPTION OF THE PREFERRED EMBODIMENTS

Figure 1:
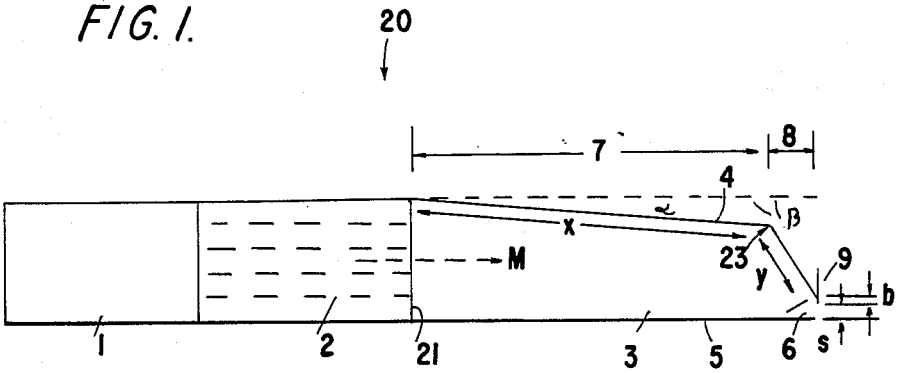
FIG. 1 shows a longitudinal section of a first construction of headbox device according to the invention.

Describing now the drawings, it is to be understood that to simplify the showing thereof only enough of the construction of the headbox device 20 for a papermaking machine has been illustrated therein as is needed to enable one skilled in the art to readily understand the underlying principles and concepts of this invention. Turning now specifically to FIG. 1 of the drawings, the headbox device 20 for a papermaking machine illustrated therein by way of example and not limitation, will be seen to comprise a distribution box or distributor 1 through which a not particularly shown fiber stock suspension or fiber stock is fed under pressure in conventional manner. A guide device 2, defining a stock guide channel, is connected subsequent to or downstream of the distribution box or distributor 1 as seen in the direction of flow M of the fiber stock suspension towards the associated papermaking machine which has not been shown since it may be of any suitable known construction and the details thereof do not constitute subject matter of the present invention.

This guide device 2 deflects or guides the fiber stock suspension in a forward or operating direction of the papermaking machine and distributes the fiber stock suspension across the width of the headbox device 20 and the associated papermaking machine. The guide device 2 may be of conventional construction and comprise a single perforated plate or multiple perforated plates 21 or a not particularly shown step-diffusor such as is described, for example, in the Swiss Pat. No. 518,406, granted Jan. 31, 1972 and published Mar. 15, 1972, and the U.S. Pat. No. 3,725,197, granted Apr. 3, 1973, to which reference may be had. It will be appreciated that other suitable constructions of guide devices may also be utilized.

As the fiber stock suspension leaves the guide device 2 in the forward or operating direction of the papermaking machine, i.e. in the direction of flow M, it enters a nozzle chamber 3. This nozzle chamber 3 is bounded on both sides by boundary walls or lip members 4 and 5. At the end of this nozzle chamber 3 situated opposite to the end bounded by the perforated plate or plates 21 and at which the fiber stock suspension enters, there is provided a slice opening or slice 6. The fiber stock suspension departing from this slice opening or slice 6 enters the wet or initial region of the not particularly shown papermaking machine.

At least one of the boundary walls or lip members 4 and 5 of the nozzle chamber 3, for example in this case the top or upper lip member 4, comprises two different zones or sections 7 and 8 as seen in the forward or operating direction of the papermaking machine, i.e. in the direction of flow M. These two different zones or sections 7 and 8 possess different angles of inclination or convergence angles relating to the direction of flow M of the fiber stock suspension. The first zone 7, defining a quieting zone, is arranged immediately subsequent to the guide device 2 and possesses a relatively small convergence angle or angle of inclination $\alpha$ which lies, for example, between 0° and 30°. The second zone or section 8, defining an acceleration zone, is arranged immediately subsequent and adjacent to the first zone or section 7 as seen in the direction of flow M of the fiber stock suspension and is located immediately prior to or upstream of the slice opening or slice 6. This second zone or section 8 possesses a substantially greater convergence angle or angle of inclination $\beta$ relative to the direction of flow M of the fiber stock suspension and which lies, for example, between 60° and 90°. A length or extent x measured along the boundary wall or lip member 4 of the first zone or section 7 is greater than a length or extent y as measured along the immediately subsequent or downstream located zone or section 8. The length x of the first zone or section 7 is preferably a multiple of the length y of the second zone or section 8, for example, four times as great. It is advantageous to select the length y of the zone or section 8 such that it is also greater than the slice width s of the slice opening or slice 6.

Instead of the described construction of the top or upper lip member 4 of the nozzle chamber 3, the bottom or lower lip member 5 of the nozzle chamber 3 can also be formed in the previously described manner. Moreover, both lip members or boundary walls 4 and 5 can be designed in the manner previously described. In any case, however, it is necessary that the nozzle chamber 3 comprise the first zone or section 7 in which the flow of the fiber stock suspension can stabilize or quiet itself after exiting from the guide device 2. Furthermore, the second zone or section 8 must be provided immediately prior to or upstream of the slice opening or slice 6 and in which the flow of the fiber stock suspension is strongly accelerated.

Furthermore, an adjustable shutter or slice shutter or baffle 9 can be provided at the slice opening or slice 6, which is constructed in a manner well known in this art. It is advantageous to select a shutter advance b of the adjustable shutter or baffle 9 such that the shutter advance b can be adjusted to a value which is between 0.05 and 0.5 times as great as the slice width s of the slice opening or slice 6.

Figure 2:
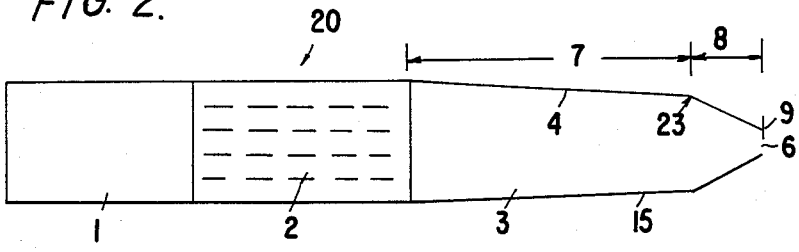
FIG. 2 shows a longitudinal section of a second construction of headbox device according to the invention.

FIG. 2 shows a modified embodiment by which not only the upper lip member 4 but likewise a bottom lip member 15 comprises two zones or sections 7 and 8 with different convergence angles or angles of inclination, i.e. with convergence angles which increase in the direction of flow M of the fiber stock suspension. Just as aforedescribed, the zone 7 defines a quieting zone and the zone 8, an acceleration zone.

It will be noted that the boundary walls or lip members 4, 5 and 15 must not possess a sharp or pronounced bend at a transition point 23 between both of the zones or sections 7 and 8, as just described with reference to the embodiments shown in FIGS. 1 and 2.

Figure 3:
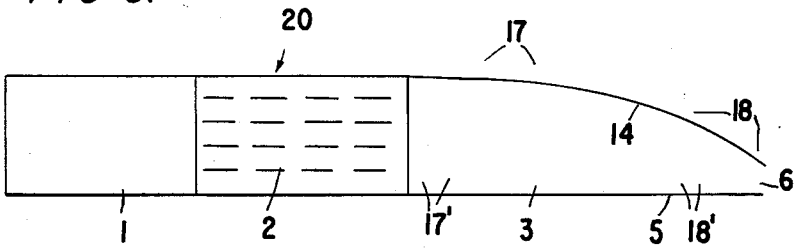
FIG. 3 shows a longitudinal section of a third construction of headbox device according to the invention.

As shown with reference to FIG. 3, however, at least one lip member or boundary wall, for example, a top or upper lip member or boundary wall 14, can possess a continuously increasing curvature or angle of inclination. In this case the acceleration of the rate of flow of the fiber stock suspension constantly increases in the forward or operating direction of the papermaking machine, i.e. in the direction of stock flow M. Furthermore, the formation or shape of the boundary walls or lip members 5 and 14 of the nozzle chamber 3 creates portions or sections or zones 17 and 18 with different convergence angles or angles of inclination, i.e. increasing convergence angles as seen in the forward or operating direction of the papermaking machine, i.e. in the direction of stock flow M. The section or zone 17 of the nozzle chamber 3 thus forms a stock stabilization or quieting zone 17' and the section or zone 18 forms a stock acceleration zone 18'.

It will be appreciated that also more than two zones or sections can be provided in the nozzle chamber 3, wherein each subsequent zone as seen in the direction of flow M of the fiber stock suspension comprises a greater convergence angle or angle of inclination than the preceding zone or section.

At least one of the boundary walls or lip members 4, 5, 14 or 15 can be pivotably mounted such that the flow of the fiber stock suspension can be optimized and the slice width s of the slice opening or slice 6 can be changed and can be adjusted according to the imposed requirements. It is also possible, however, to form only the last zone or section 8 of a boundary wall or lip member so that it is pivotable or displaceable, or to provide a local adjustability of the slice opening or slice 6 across the operating width of the headbox 20.

It will be understood that the terms "before", "preceding" and "upstream" or equivalent terminology refer to regions of the headbox device 20 which the fiber stock suspension has already passed, while the terms "following", "subsequent" and "downstream" or equivalent terminology refer to regions which the fiber stock suspension has not yet reached relative to the point currently under discussion.

While there are shown and described present preferred embodiments of the invention, it is to be distinctly understood that the invention is not limited thereto, but may be otherwise variously embodied and practiced within the scope of the following claims.

Accordingly, what we claim is:

1. A headbox device for a papermaking machine and having a predetermined direction of flow for a fiber stock suspension passing through the headbox device, comprising:

a distribution box;

a nozzle chamber;

a guide device for conducting the fiber stock suspension in said predetermined direction of flow and serving for distributing the fiber stock suspension across the width of the papermaking machine;

said guide device being located subsequent to said distribution box as seen in said predetermined direction of flow of the fiber stock suspension;

said guide device flow communicating with said nozzle chamber;

said nozzle chamber comprising two lip members defining a slice opening leading to the papermaking machine;

at least one of said two lip members of said nozzle chamber comprising at least two sections with substantially different convergence angles relative to said predetermined direction of flow of the fiber stock suspension;

at least one section of said at least two sections being connected directly subsequently to said guide device and having a first convergence angle of said substantially different convergence angles;

said at least one section of said one lip member defining a quieting zone for substantially equalizing flow velocities of the fiber stock suspension;

at least one further section of said at least two sections lying directly prior to said slice opening of said nozzle chamber and having a second convergence angle of said substantially different convergence angles;

said at least one further section defining an acceleration zone for abruptly accelerating the fiber stock suspension;

said at least one section having a length which is a multiple of the length of said at least one further section;

said first convergence angle lying between 0° and 30°; and said second convergence angle lying between 60° and 90°.

2. The headbox device as defined in claim 1, wherein:

the length of said at least one section is at least four times as great as the length of said at least one further section.

3. The headbox device as defined in claim 1, wherein:

said slice opening has a predetermined slice width; and the length of said at least one further section being greater than said predetermined slice width of said slice opening.

4. The headbox device as defined in claim 3, further including:

a slice shutter mounted at the at least one further section, which has said convergence angle in the range of 60° to 90°, in the region of the slice opening and having a predeterminate degree of advance; and said slice shutter being displaceable such that said predeterminate degree of advance of said slice shutter is adjustable in a range lying between 0.05 and 0.5 times said predetermined slice width of said slice opening.

5. The headbox device as defined in claim 1, wherein:

at least one of said at least one section and said at least one further section respectively extending at said first convergence angle between 0° and 30° and said second convergence angle in the range of 60° to 90°, extends at a convergence angle which continuously increases within the respective convergence angle range in said nozzle chamber in said predetermined direction of flow of the fiber stock suspension.

6. The headbox device as defined in claim 1, wherein:

at least one of said at least one section and said at least one further section is pivotably mounted.

7. The headbox device as defined in claim 1, wherein:

at least one of said at least one section and said at least one further section is displaceably mounted.

8. A headbox device for a papermaking machine and having a predetermined direction of flow for a fiber stock suspension passing through the headbox device, comprising:

means defining a nozzle chamber through which the fiber stock suspension is passed from the headbox to the papermaking machine;

said nozzle chamber comprising two lip members defining a slice opening for the outflow of the fiber stock suspension;

at least one of said two lip members of said nozzle chamber comprising at least two sections with substantially different angles of inclination converging with respect to said predetermined direction of flow of the fiber stock suspension;

at least one section of said at least two sections having a first converging inclination angle of said substantially different converging inclination angles;

said first converging inclination angle lying between 0° and 30°;

said at least one section bounding a quieting zone for substantially equalizing flow velocities of the fiber stock suspension;

at least one further section of said at least two sections having a second converging inclination angle of said substantially different converging inclination angles;

said at least one further section bounding an acceleration zone for abruptly accelerating the fiber stock suspension;

said second converging inclination angle lying between 60° and 90°;

said at least one section having said first converging inclination angle being located on an inlet side of said nozzle chamber;

said at least one further section being located substantially immediately upstream of and in close proximity to said slice opening as viewed in said predetermined direction of flow of said fiber stock suspension; and said at least one section having a length which is greater than the length of said at least one further section.

9. The headbox device as defined in claim 8, wherein:

said second converging inclination angle of said acceleration zone is of a magnitude sufficient for producing shear forces for disintegrating floccules present in the fiber stock suspension.

* * * * *